US005209283A

United States Patent [19]

Miltzow et al.

[11] Patent Number: 5,209,283

[45] Date of Patent: May 11, 1993

[54] ROLL AND/OR ROLLER FOR MACHINES OF CONTINUOUS CASTING

[75] Inventors: Bernd Miltzow; Franz Schuster, both of Duesseldorf, Fed. Rep. of Germany

[73] Assignee: Mannesmann AG, Düsseldorf, Fed. Rep. of Germany

[21] Appl. No.: 681,623

[22] Filed: Apr. 1, 1991

Related U.S. Application Data

[63] Continuation of Ser. No. 376,855, Jul. 7, 1989, abandoned.

[30] Foreign Application Priority Data

Jul. 8, 1988 [DE] Fed. Rep. of Germany ..... 3823655

[51] Int. Cl.[5] ..... B22D 11/128

[52] U.S. Cl. ..... 164/448; 164/442; 442/7; 442/46

[58] Field of Search ..... 164/442, 448; 72/201, 72/236; 29/116.1, 127, 130; 228/140

[56] References Cited

U.S. PATENT DOCUMENTS

| | | | |
|---|---|---|---|
| 4,137,963 | 2/1979 | Langer | 164/442 |
| 4,270,254 | 6/1981 | Berglöff | 29/127 |
| 4,351,383 | 10/1982 | Gladwin | 164/442 |
| 4,631,792 | 12/1986 | Wesemann | 29/127 |
| 4,683,628 | 8/1987 | Schönemann | 29/130 |
| 4,711,291 | 12/1987 | Reinhold | 29/127 |
| 4,864,703 | 10/1989 | Biondetti | 29/116.1 |

FOREIGN PATENT DOCUMENTS

| | | | |
|---|---|---|---|
| 3231433 | 2/1984 | Fed. Rep. of Germany . | |
| 47-29695 | 8/1972 | Japan | 164/448 |
| 57-9569 | 1/1982 | Japan | 164/448 |
| 63-68205 | 3/1988 | Japan | 29/116.1 |
| 63-252653 | 10/1988 | Japan | 164/442 |

*Primary Examiner*—Richard K. Seidel
*Assistant Examiner*—Rex E. Pelto
*Attorney, Agent, or Firm*—Ralf H. Siegemund

[57] ABSTRACT

The roll and roller has a core with a threaded on sleeve of differently radially high threads such that the crown or head of one thread reaches the bottom/foot of the thread groove way of the other, but not vice versa so that a spiral channel is established while the abutting foot/crown configuration is welded indirectly as a weld layer is deposited onto the outer surface of the sleeve.

15 Claims, 1 Drawing Sheet

ROLL AND/OR ROLLER FOR MACHINES OF CONTINUOUS CASTING

This is a continuation of co-pending application Ser. No. 376,855, filed on Jul. 7, 1989, now abandoned.

BACKGROUND OF THE INVENTION

The present invention relates to a support and transport roll or roller for metal ingots particularly for use in continuous casting e.g. of steel, such as a roller is assumed to have a core with cooling channels in its surface and being inserted in a tubular sleeve whose inside is correspondingly grooved for closing these channels. In addition the invention relates to the making of such a core and of associated structure.

German printed patent application 1583619 discloses a transport and support roll or roller for use in the transport path of continuous casting machines and having a hollow axle or shaft to serve as conduit for a coolant, also providing appropriate journal mounts acting between shaft core and outer sleeve. The particular configuration as disclosed is disadvantaged by the fact that the sleeve is a very complicated object to make. This is particularly so since its wall thickness is significant. Another drawback of this arrangement is the fact that charge and discharge of coolants through conduit channels is carried out through turning bearings arranged on the side inside of the roller. Such a construction requires a rather cumbersome, expensive and complicated conduction arrangement for the coolant to the front ends of the roll and the back.

U.S. Pat. No. 2,998,999 discloses hydrostatic bearings which are arranged on a shaft outside of the outer sleeve and require their own liquid supply. This too is a rather complex kind of arrangement. U.S. Pat. No. 4,631,792 corresponding to German patent 32 31 433 discloses an internally cooled support and/or transport roller with an outer sleeve which is connected to the core by welding in between the channels through covering all of the surfaces of contact as between the sleeve and the core. In order to provide for the welding a groove is worked in the sleeve and is then filled with welding material. This kind of arrangement is disadvantaged by a high tension load in the groove. Also, the welding electrodes require very complex guiding because the sleeve groove provides inherently a rather narrow area of working.

The same German patent discloses also the providing of a connection between sleeve and core such that in the front face of the bar (that separates cooling ducts) a thread is cut which engages a corresponding thread of the inside of the sleeve. In still another version the rod or bar between cores and the cooling channel is configured in a trapezoidal threadlike fashion. The bar has its front face connected or cooperating with the corresponding engagement in the inner jacket of the sleeve. Both kinds of configurations are disadvantaged by the fact that the sleeve is connected to the core only in a form and shape closed manner which makes it possible that there is movement between the elements.

DESCRIPTION OF THE INVENTION

It is an object of the present invention to avoid the various drawbacks outlined above and to provide a new and improved support roll or roller which is cooled on the inside, manufactured from simple components, has a high bending stiffness and a low sensitivity towards rupture or tearing.

It is also specific object of the present invention to provide a new and improved transport and support roller for continuous metal casting, the roll or roller having a core whose surface is provided with a threadlike cutting establishing a cooling channel and being in engagement with a corresponding ridge on the inside surface of a sleeve which is threaded onto the core.

It is another object of the present invention to provide a new and improved method of connecting the core and sleeve of a transport roller configuration of the kind allocated to a bore, for use in continuous casting machines.

In accordance with the preferred embodiment of the present invention it is suggested to provide the outer jacket portion of the sleeve with a weld deposit layer to connect indirectly the threaded head or crown of the core (or sleeve) with the foot of the sleeve (or core) by means of the welding heat and in a relative position which is kept invariant after welding while there is a spiral channel by a radial gap between the respective other head or crown and the foot portion of the thread ways in question. Moreover it is suggested to provide the core with a central bore and stationary bearing pins are inserted into the bore of the core but with a radial gap or play. The connection is made such that the sleeve and the core are threaded in relation to each other and that upon placing the weld deposit on the outer jacket of the sleeve the threaded head of the core is intimately connected with the threaded foot of the sleeve. The pins are provided with bores and the core has annular manifold openings or spaces at its axial ends so that coolant can be fed into the spiral channel.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
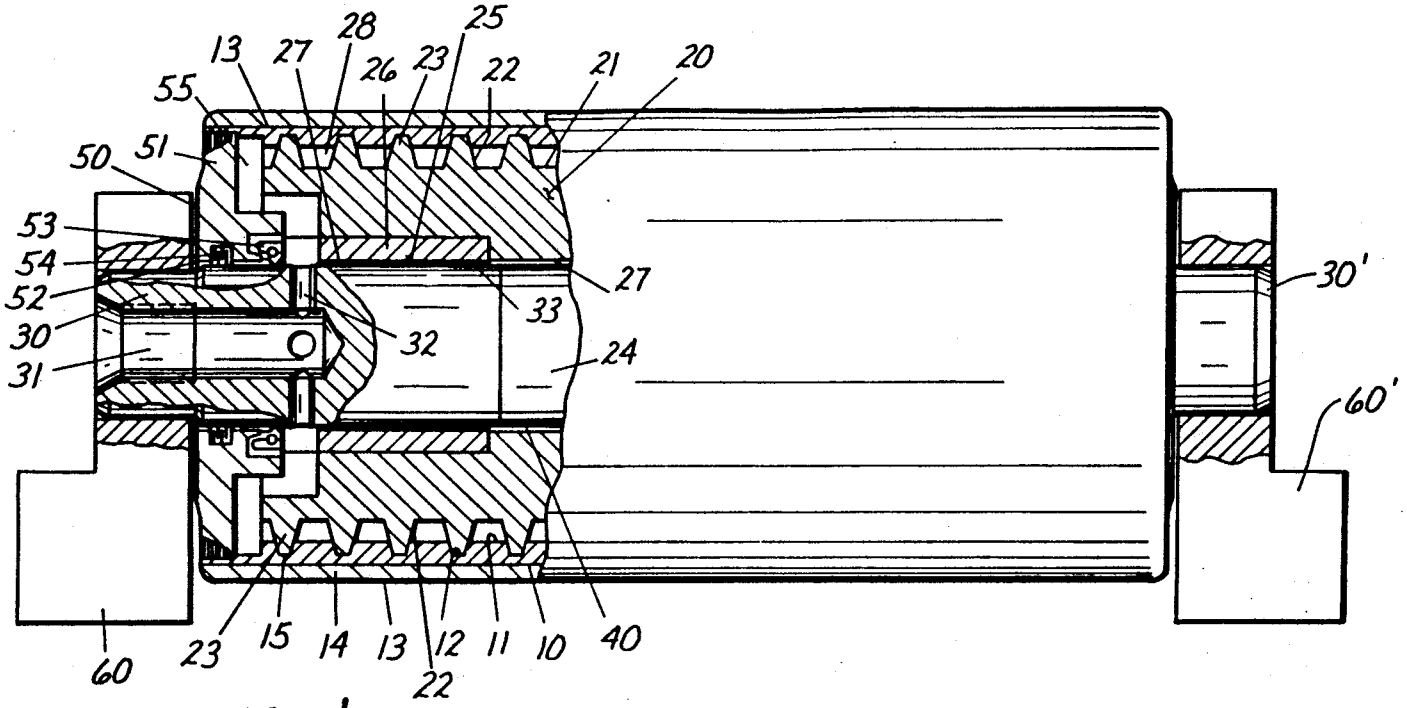
FIG. 1 illustrates a partial cross section, partially a side elevation of a roll and roller constructed in accordance with the preferred embodiment for practicing the best mode thereof particularly as far as making such roll and roller is concerned.

Proceeding now to the detailed description of the drawings, the roll or roller illustrates includes the following basic or major components. There is a sleeve 10, a core 20, stationary bearing pins 30 and 30', such pin or bearing being connected to a carrier structure 60 and 60'. The figure shows in detail only the left-hand arrangement of pin (30) and its mounting and positioning (60) but the right hand side is analogously configured (30', 60').

The sleeve 10 includes an outer jacket 13 which in turn carries a weld deposit 14. On the other hand the inside surface 11 of the sleeve 10 is provided with threadways 12. The core 20 on the other hand has an outer surface 21 which is provided with threadways 22. The threadways of sleeve and core are of matching configuration so that indeed the core 20 can be and has been threaded into the sleeve 10.

As the threaded connection between core and sleeve is made up the head or crown 23 of cores 20 threadway ridges is then positioned and arrested in relation to the thread foot portion 15 of the threadway groove in sleeve 10. The core 20 is provided with a central bore 24 being a cylindrical opening. Specific bearing surfaces 25 are provided at both ends of this bore. For reasons of maintenance and endurance these bearing surfaces are that of sleeves 26 being inserted in bore 24 and thus provided whereever a bearing function is to be provided.

The stationary bearing and journal pins 30 and 30' are plugged in or struck into the central cylindrical bore 24 of the core 20. These pins 30, 30' are positioned such that between the particular bearing surface 33 of the pin 30 (or 30') on one hand, and the internal surface 25 of the sleeve and the surface 27 of bore 24 on the other hand there remains a gap 40. Each of the pins 30 and 30' is provided with an axial blind bore such as 31 which in turn is provided with several (at least two) radially extending bores 32.

The front face 50 actually of both, the roller as a whole and of the core is configured as a lid element or cover 51 which in turn is provided with a central bore 52. For reasons of sealing and in order to prevent interference and deposit of soil and dirt sealing rings 53 as well as dirt catchers or traps 54 are provided in annular grooves of the bore 52 of the lid 51.

The unit as established by sleeve 20, core 30, pins 30 and carrier element 60 are as such installed in a machine for continuous casting. Tubing is provided from the outside to be connected to the axial blind bore 31. This bore is provided for the conduction of the coolant medium such as water. The water flows through the bearing pin 30, particularly the axial blind bore 31, and into the radial bore 32. In order to reach the space 55 between the front face of the core 20 and the inside of the cover 51 bore 32 open in the manifold space 55. Coolant will reach in fact the gap space 40 between the sleeve 10 and the core 20, as 40 communicates with manifold chamber 55.

The thread ways 12 and 22 respectively of sleeve 10 and core 20 are configured to be not complete in form and contour matching engagement so that indeed a channel is established between the threadway ridges of the sleeve and the thread groove or foot portion of the core's thread. The cooling medium flows through this channel 28 in a spiral path. The spiral path begins on one hand on an axial end of the roll and of the sleeve-core arrangement, follows its spiral configuration and leaves this arrangement through a bore arrangement on the other end (pin 30') which is the same as the one on the inlet side. A part or portion of coolant will traverse the gap 40 to reach the other side and the other end of the roller and thus fills basically the central bore 24 of the core 20 in between the two pins 30, 30' and will flow out of the analogous gap 40 and will combine flow in order to flow out of the system through the bores in the pin 30' of the other end. It is pointed out that the coolant in gap 40 acts as coolant as well as lubricant.

It can thus be seen that the inventive roll or roller is made of a sleeve 10 on a core 20 which parts are manufactured initially separately whereby the core may result from cutting short lengths from a long rod. Analogously more or less endless tubing may be provided from which individual sleeves 10 are cut. Into these constructively simple, but rather long elements which will become sleeve and core, one will cut the respective threadways 12 and 22. Subsequently a cut sleeve 10 is threaded onto a cut core 20 in order to provide form closed position and fixing of the respective core and the sleeve.

Figure 2:
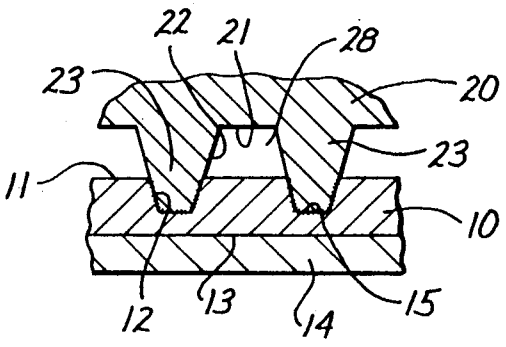
FIG. 2 is a detail of the section shown in FIG. 1.

In a separate working step, weld deposit is provided. Here the welding parameters are selected so that for a matched wall thickness of the sleeve 10 and upon welding the protective deposit the entire thermally affected zone will reach deep into the sleeve which is in fact down to the foot portion 15 of the thread in the sleeve 10. This way one obtains simultaneously a welded connection the core and the sleeve just by virtue of the heat that is applied. This welding thus connects the threaded ridge or bar or crown 23 head of the core 20 with the thread foot 15 of the sleeve 10 in a careful manner, so that both components exhibit only small conversion zones as far as the heated raw material is concerned. See also FIG. 2. Thus any tension introduced into the roller on account of the welding is induced to a minimum.

It should be mentioned that the deposit welding counteracts any propensity towards thermoshock cracking. Bearing in mind that the use of roll or roller occurs in a rather rough environment one because a continuous casting machine is far from being a gentle mode of operation. Hence the sleeve by and in itself is loaded thermally while under pressure and gravity forces while acted upon by in an extreme fashion. On the other hand the careful connecting welding provided here will not add to that load because a large portion of the forces resulting from different expansion of sleeve 20 will be taken up by the thread in the operatively effective, form closed connection. These forces will be minimized owing to the carefully designed flow path of the coolant.

Other forces which the roll or roller may have to take up are bending forces during continuous casting while carrying the ingot. The inventive configuration as shown provides a support and bearing structure for the roller. These are the pins 30, 30' which have been placed deep inside the core. Owing to the relatively high thickness of the core i.e. owing to the large diameter differential between the internal bore 24 on one hand and the outer surface of the core 20 on the other hand, and a deep insertion of the bearing pins 30, 30' minimizes drastically the bending forces that may still act on the roller.

The arrangement of the bearing pins 30, 30' in deep penetration of the bore 24 is deemed desirable makes possible the utilization of a coolant as lubricant, lubricating the bearing in the journal mount that results therefrom. In fact as outlined above the water runs through the gap 40 whereby the surface of the pin 30 is covered in each case by the sleeve part 26 made of wearproof material such as $ZrO_2$.

For reasons mentioned briefly earlier the bearing surface in the bore 24 of the core 20 is provided through a sleeve 26. The internal surface 25 of the sleeve is likewise coated with wearproof material of the type mentioned above ($ZrO_2$). As stated, between the pin 30 and the sleeve 10 there is a radial gap 40 having an order of magnitude such that the liquid coolant can indeed flow through so as to serve both as lubricant as well as coolant. The bearing surfaces in the case have a size and configuration such that the surface tension is minimized.

The arrangement of bearings for the roller by means of these pins 30 and 30' deep inside the roller body has the additional advantage that the water can be fed to and from the spiral coolant channel 28 relatively far from the outer ends of the roll and roller. A portion of this coolant is passed through the central bore and serves cooling as well as lubrication. In fact the entire bore 24 will normally be filled with coolant and that is a very effective way of cooling the roll as a whole.

The lids or cones 51 at the ends of the sleeve/core combination will not act as far as force and tension are concerned, either on the call or on the sleeve 10. The function of these covers 51 is limited to serving as a manifold for the flow of water first in radial outer direction then into the spiral channel 28, while directly lubricating coolant flows from the manifold space 52 into the gap 40 as described. In addition, the covers serve as an implement holder through which the inclusion of dirt, soil can be prevented.

The invention is not limited to the embodiments described above but all changes and modifications thereof, not constituting departures from the spirit and scope of the invention, are intended to be included.

We claim:

1. Support and transport structure including a roller or roll in a machine for continuous casting, the roller or roll having a core and an outer sleeve, there being a threaded connection between them, the structure further comprising:

an entire outer portion of the sleeve being a weld-deposit layer;

said core having an outer threadway with crowns and roots of a particular height, the sleeve having an inner threadway with crowns and roots of a height different from the particular height, the core being threaded into the sleeve so that the crown of one of said inner and outer threadways abuts the root of the other of said inner and outer threadway so that a spiral channel results between the crown of the other threadway and the root of the one threadway;

the respective abutting crowns and roots being intimately bonded together on account of the placement of said weld deposit layer having caused heat to migrate into zones of the abutting crown and root resulting in a weld bond between the abutting crown and root;

said core having a central bore;

bearing pins inserted respectively from opposite ends into the central bore for journalling the roll or roller, there being a gap between the pins and the bore;

mounting means for stationarily mounting said pins; and duct means in the pins to conduct coolant to and from the gap and the channel.

2. Structure in accordance with claim 1, further comprising holders connected to the pins at the opposite front faces of the roll and roller, these bearing pins being connected to the carrier element only outside of the roll or roller.

3. Structure in accordance with claim 2, the duct means in the bearing pins including a central axial blind bore from which extend radially further blind bores to serve for charging and discharging of coolant.

4. Structure as in claim 3 and further including cover means at the front ends of the roller being provided with a central bore having a radius which is larger than the radius of the traversing bearing pin.

5. Structure as in claim 4, further comprising sealing rings in the bores of the cover engaging and enveloping the respective pin.

6. Structure as in claim 5, said bearing pin having surfaces means for engaging bearing surfaces in the roll or roller, the surface means being a coating of wearproof material.

7. Structure as in claim 6, said wearproof material being zirconium oxide.

8. Structure as in claim 1, said roll being provided with bearing sleeves inside the bore of the core.

9. Structure as in claim 1, wherein said bearing sleeve and core are threaded into each other and welded whereby specifically the thread crown of the core is weld-connected with the thread foot of the sleeve.

10. Structure as in claim 1, wherein the weld deposit amounts from narrowly placing welding beads and loops onto the sleeve.

11. Structure as in claim 10 wherein the beads and loops have the same pitch as said spiral channel.

12. Support and transport structure including a roller or roll in a machine for continuous casting, the roller or roll having a core and an outer sleeve, there being a threaded connection between them, the structure further comprising:

said core having an outer threadway with crown and roots of a particular height, the sleeve having an inner threadway with crown and roots of a height different from the particular height, the core being threaded into the sleeve so that the crown of one of said inner and outer threadways abuts the root of the other of said inner and outer threadway so that a spiral channel results between the crown of the other threadway and the root of the one threadway;

the respective abutting crowns and roots being intimately weld-bonded together;

said core having a central bore, there being duct means for connecting the spiral channel to the bore;

bearing pins inserted respectively from opposite ends into the central bore for journalling the roll or roller, there being a gap between the pins and the bore and thereby to the channel;

mounting means for stationarily mounting said pins; and duct means in the pins to conduct coolant to and from the gap and the channel.

13. Support and transport structure as in claim 12, the duct means in the pins including an axial blind bore and radial bores extending therefrom.

14. Support and transport structure as in claim 12, there being covers at the end of the core, having a central bore larger than a diameter of the pins.

15. Support and transport structure as in claim 14, there being seals in the covers engaging the respective pin.

* * * * *